US006962377B2

(12) United States Patent
Tönges

(10) Patent No.: US 6,962,377 B2
(45) Date of Patent: Nov. 8, 2005

(54) DRIVING ROD LOCK FOR A SLIDING DOOR

(75) Inventor: Reiner Tönges, Heiligenhaus (DE)

(73) Assignee: Carl Fuhr GmbH & Co. KG, Heiligenhaus (DE)

( * ) Notice: Subject to any disclaimer, the term of this patent is extended or adjusted under 35 U.S.C. 154(b) by 0 days.

(21) Appl. No.: 10/350,848

(22) Filed: Jan. 24, 2003

(65) Prior Publication Data

US 2003/0160462 A1 Aug. 28, 2003

(30) Foreign Application Priority Data

Feb. 27, 2002 (DE) ..... 102 09 573

(51) Int. Cl.[7] ..... E05B 63/20
(52) U.S. Cl. ..... 292/332; 292/DIG. 46
(58) Field of Search ..... 292/332, 333, 292/336, DIG. 46

(56) References Cited

U.S. PATENT DOCUMENTS 1,047,900 A * 12/1912 Voight ..... 292/336
2,887,336 A * 5/1959 Meyer ..... 292/21
4,508,378 A * 4/1985 Rochman ..... 292/333
5,542,720 A * 8/1996 Fleming ..... 292/32
6,174,004 B1 * 1/2001 Picard et al. ..... 292/165

FOREIGN PATENT DOCUMENTS

EP 0757146 2/1997

* cited by examiner

*Primary Examiner*—Gary Estremsky
(74) *Attorney, Agent, or Firm*—Martin A. Faber

(57) ABSTRACT

A driving rod lock for a sliding door, with a lock housing (2) which is arranged to the rear of a cuff plate (1) and which comprises a driving member for a driving rod (3) for driving bolt elements (4), which driving rod is displacable between a blocked position and an open position of the lock by actuation of the driving member along the rear side of the cuff plate, with a tracer (5) which extends through an opening of the cuff plate (1) and which, with a blocking section (6) arranged in the lock housing (2), blocks displacement of the driving rod (2) from the open into the closed position and releases displacement in a position pressed in against the force of a return spring (7). Improving a such sliding door lock with respect to handling, the driving member is a latch nut (8).

10 Claims, 5 Drawing Sheets

DRIVING ROD LOCK FOR A SLIDING DOOR

FIELD AND BACKGROUND OF THE INVENTION

The invention concerns a driving rod lock for a sliding door, with a lock housing which is arranged to the rear of a cuff plate and which comprises a driving member for a driving rod for driving bolt elements, which driving rod is displaceable between a blocked position and an open position of the lock by actuation of the driving member along the rear side of the cuff plate, with a tracer which extends through an opening of the cuff plate and which, with a blocking section arranged in the lock housing, blocks displacement of the driving rod from the open into the closed position.

A lock of this kind is known from EP 0 757 146 A1. The lock described there has a driving rod which is located to the rear of a cuff plate. Through openings of the cuff plate extend hooked catches which together with the driving rod are displaceable from an open position into a blocked position in which the hooked catches enter corresponding catch entry openings of a striking plate and latch there. Out of an opening of the cuff plate extends a tracer which is acted upon by the striking plate when the door is closed. The tracer has a blocking section with which in its advanced position it blocks displacement of the driving rod, so that the latter is displaceable from the open to the blocked position only when the tracer is pressed in. The driving rod is driven with a driving member. The driving member there is a slide.

SUMMARY OF THE INVENTION

It is the object of the invention to improve a generic sliding door lock with respect to handling.

The object is achieved by the invention provided in the claims.

According to the invention the driving member is a latch nut. This latch nut is rotated for displacement of the driving rod from the open position into the blocked position. This is possible when the tracer is actuated with a latch handle. The latch handle can also be used to displace the sliding door. The sliding door can therefore be displaced out of its open position into the closed position by engagement of the latch. When the closed position is reached, then the tracer is displaced into its release position by the striking plate of the frame or of an opposite door leaf. When this position is reached, then the driving rod can he displaced from the open position into the closed position. It proves extraordinarily advantageous if the latch handle is a one-armed handle which is positioned with the arm pointing downwards in a vertical position. The tracer which fixes the driving rod in the open position also fixes the nut by means of a transmission mechanism between driving rod and nut, so that the latter cannot rotate. If therefore in the open position of the door a pushing force is applied to the one-armed latch handle, the latter cannot rotate as a result of the blocked nut. The force applied to the latch handle is therefore used exclusively for sliding the door leaf. When the door leaf reaches its end position from pushing, then the tracer is acted upon and so displacement of the driving rod is released. The torque now still acting on the latch handle as a result of the pushing force causes rotational actuation of the nut, which results in displacement of the driving rod from the open position into the closed position and locking of the bolt elements. The sliding door leaf can therefore be closed and bolted by a single pushing movement. The latch handle according to the invention fulfils a dual function. It serves on the one hand as a handle for sliding the sliding door and on the other hand as an actuating member for the driving rod lock. It is important here that the direction of rotation of the latch nut is adjusted to the direction of pushing the sliding door in such a way that the latter and the direction of closing are the same. In a development of the invention it is provided that a driving rod connecting slide is guided in the lock housing. This driving rod connecting slide is engaged by a driving lever which is pivotable about a shaft fixed to the housing. The driving lever can be actuated by an arm of the latch nut. The rotational movement of the latch nut is thus transmitted by means of a transmission mechanism to the driving rod connecting slide, It is advantageous if the driving lever forms a short lever arm, which is formed by a cam. This cam can lie with play in a notch of the nut arm. The play is preferably selected such that the nut can stay in a central, neutral position independently of the position of the driving rod. This central, neutral position can be maintained by a spring assembly. The driving lever can cooperate with a positioning spring. This positioning spring can, as a result of over-centre control, hold the driving rod connecting slide both in a position associated with the blocked position and in one associated with the closed position. The holding force which the positioning spring exerts on the driving lever or on the driving rod is great enough to prevent return of the driving rod due to force of gravity. Particularly preferred is an embodiment of the positioning spring as a leg spring. An arm of the leg spring can in this case be obtusely angled and act against a projection of the driving lever. The bearing shaft of the driving lever can extend through an arcuate slot of the nut arm. Nut arm and driving lever lie one over the other as a result, which leads to a compact design. The tracer can also be acted upon by a leg spring. The tracer is preferably designed as a slide, wherein the slide is formed by a sheet metal stamping. With a blocking extension this slide can cooperate with sawtooth-shaped blocking teeth of the driving rod connecting slide. The slopes of the sawtooth-shaped blocking tooth cause the driving rod connecting slide to be capable of being displaced into the open position independently of the position of the tracer. In the process the blocking extension runs over the blocking teeth. The tracer is preferably mounted in a plastic guide moulding. This guide moulding can also form the bearing pin for the leg spring which acts on the tracer. In a preferred variant of the invention, the driving rod connecting slide has a blocking shoulder. In the blocking position of the driving rod connecting slide, the blocking shoulder assumes such a position that there can be applied to it a blocking member which prevents displacement of the driving rod from the blocked position into the open position. Preferably this blocking member is an arm of a blocking nut. The blocking nut can be fixed with a leg spring in its two end positions, which are offset from each other by 90°.

The invention furthermore also concerns a sliding door fitted with the driving rod lock described above, wherein it is essential that the handle inserted in the latch nut has an arm which is in the vertical position and which is to be pivoted in the closing direction of the sliding door to close the lock.

A practical example of the invention is described below with the aid of attached drawings. They show:

Figure 1:
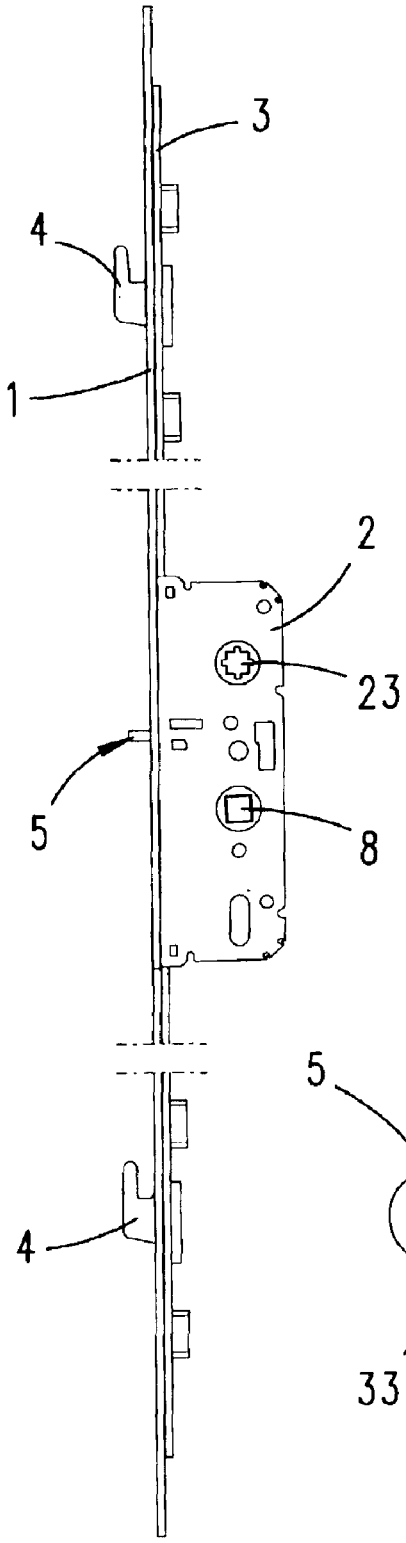
FIG. 1 a general view of the sliding door lock according to the invention
Figure 3:
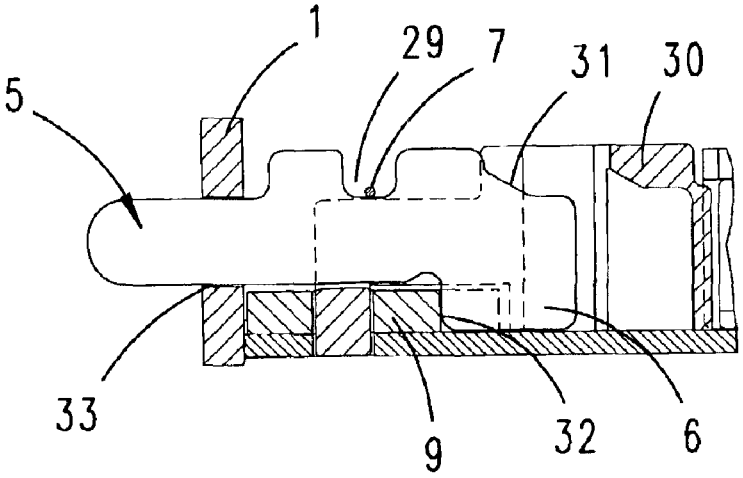

The driving rod lock has a cuff plate 1. To the rear of the cuff plate 1 is located a driving rod 3 slidable along the cuff plate 1. This driving rod 3 extends out of the lock housing 2 both at the top and at the bottom. In the practical example the driving rod 2 consists of two individual driving rod elements which each drive a hooked catch 4. The catch elements are designed as thrust hooks in the practical example. But they can also be designed as pivot hooks.

In the lock housing is located a tracer 5. This tracer is designed as a slide and has a section which extends through an opening 33 of the cuff plate 1 and which, when the door fitted with the lock is closed, strikes a striking plate. To the rear, the tracer 5 has a stop 32 which in the extended tracer position strikes a driving rod connecting slide 9 guided on the lock bottom. A rear guide flank 31 of the tracer is covered by a guide web 30 of a plastic guide moulding 19. The tracer 5 is guided linearly in a guide shaft of the guide moulding 19. With a spring 29 the tracer is spring-loaded.

The driving rod connecting slide 9 is guided linearly on the bottom of the lock. The driving rod connecting slide 9 is coupled by hook connections to the driving rod 2 for movement. The driving rod connecting slide 9 has sawtooth-shaped blocking teeth 18 which cooperate with the blocking extension 6 of the tracer 5, which forms the stop 32. As a result, the driving rod connecting slide 9 is held in the open position when the tracer 5 is advanced.

The driving rod connecting slide 9 has a notch 28. In this notch 28 engages a driving projection 27 of a driving lever 11. The driving lever 11 is mounted so as to be pivotable about a shaft 10 fixed to the housing. The driving lever 11 is two-armed. The longer arm of the driving lever 11 forms the driving projection 27. The short arm of the driving lever 11 forms a cam 13. This cam 13 lies in a notch 14 of a nut arm 12 of a latch nut 8. The cam 13 lies with play in the notch 14 of the nut arm 12, so that the latch nut can be held in a central, neutral position independently of the position of the driving rod connecting slide 9. In order to hold the nut 8 in the central, neutral position, there is provided a spring assembly 16 which can be acted upon by a nut arm and applies the required return force for holding the nut in the central, neutral position.

The leg spring 15 has an angled arm. The two arm sections 15', 15" cooperate with a projection 25 of the driving lever 11. The action of the leg spring 15 is loading the driving lever in the direction of its respective pivot end position. Upon pivoting of the driving lever 11, the projection 25 runs over the apex of the arms 15', 15".

The plastic guide moulding 19 forms said guide slot for the tracer 5. Furthermore it also forms the bearing pin 20 for the tracer spring 7. With an extension the guide moulding 19 passes through a longitudinal slot 26 of the driving rod connecting slide.

Figure 6:
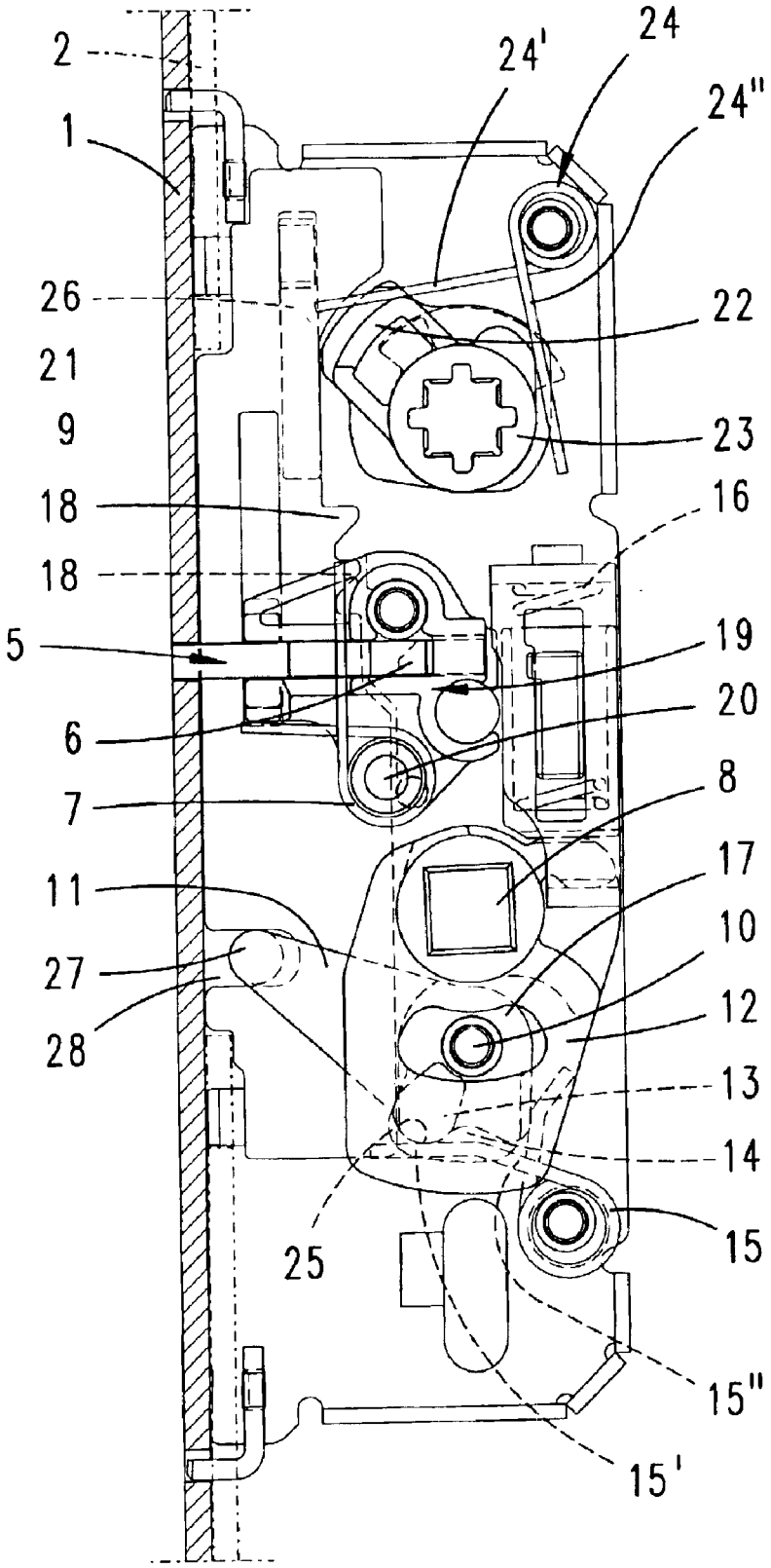

The driving rod connecting slide has a blocking shoulder 21. In the blocking position, a blocking member 22 of a blocking nut 23 can place itself in front of this blocking shoulder 21. This is effected by pivoting the blocking nut 23. In the unblocked position shown in FIG. 2, the blocking nut 23 is held with a leg spring 24. The blocking nut 23 is also held in the blocking position shown in FIG. 6 by precisely this blocking nut spring 24. For this purpose the two blocking nut spring legs 24', 24", which adopt approximately a 90° angle to each other, engage flattened portions of the blocking nut 23 which describe approximately a 90° angle to each other.

Figure 2:
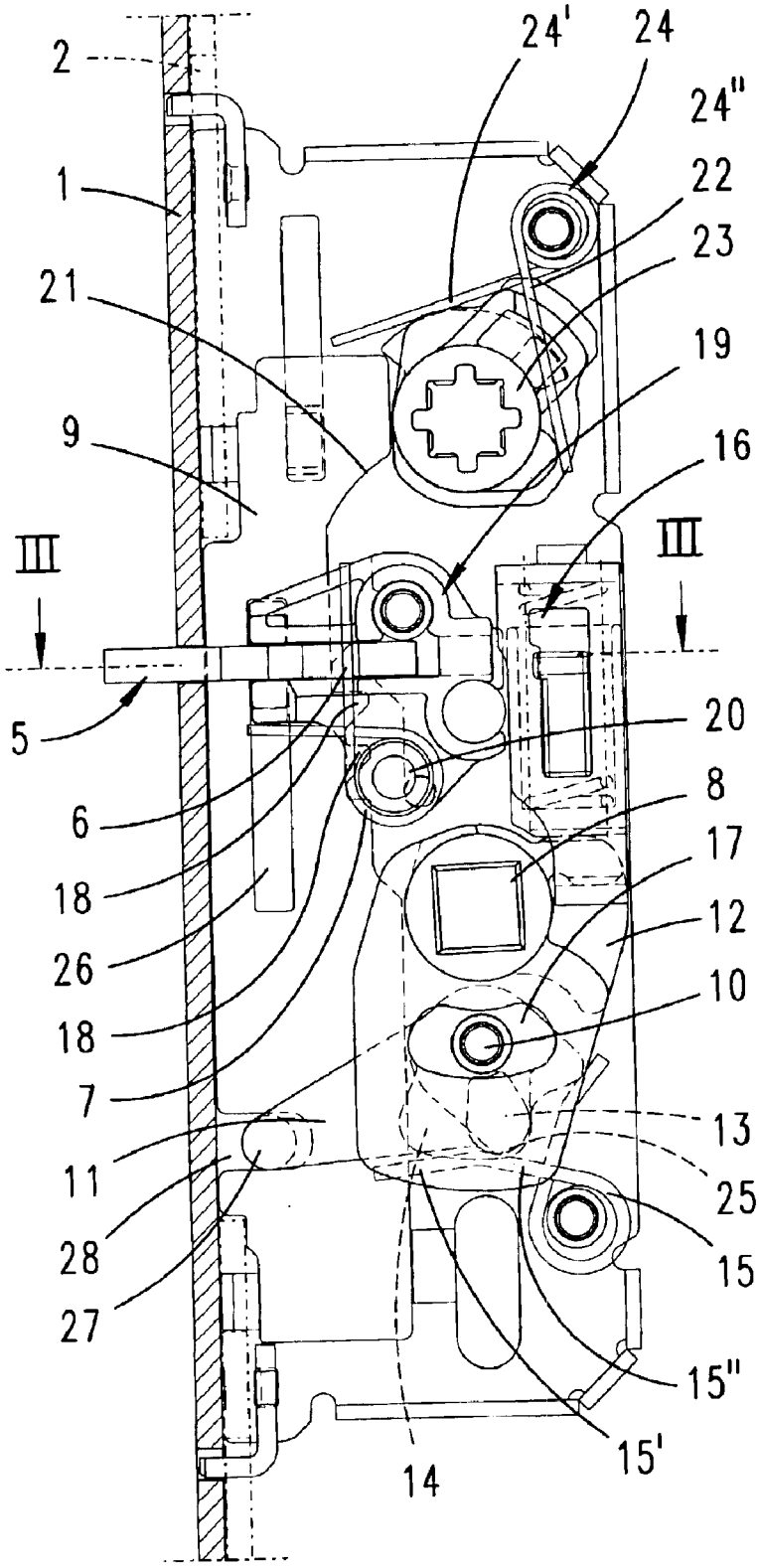
FIG. 2 a view of the lock ward with the lock cover removed and the tracer in the blocking position, FIG. 3 a section along line III—III, FIG. 4 a view as in FIG. 2 with the tracer actuated and with the latch nut pivoted into the open position, FIG. 5 a subsequent view to FIG. 4 with the driving rod displaced into the blocked position and the latch nut pivoted into the locked position, and FIG. 6 a subsequent view to FIG. 5 with the blocking member moved into the blocking position.

The manner of operation of the lock is the following:

Starting from the open position shown in FIG. 2, in which a one-armed latch handle, not shown, projects downwardly and fits with its square mandrel in the latch nut 8, the mandrel is acted upon in the closing direction of the sliding door. This is to the left in the drawings. By the fact that a wall of the notch 14 acts against the cam 13, the driving projection 27 in the notch 28 pushes upwards and the driving rod connecting slide 9 is blocked as a result of the blocking extension 6 of the tracer 5 located in front of one or more blocking teeth 18, the latch nut 8 cannot turn. The torque applied to the latch nut 8 therefore cannot be converted to a linear displacement of the driving rod out of the open position into the closed position. The force applied to the latch instead leads only to closing of the door, until the tracer 5 acts on the striking plate of the frame or of an opposite leaf. The tracer is then returned against the return force of the tracer spring 7. The blocking extension 6 is disengaged from the blocking teeth 18. The displacement capacity of the driving rod 2 is released. The catch members can move upwardly into the catch entry openings of the striking plate associated with them. This is all connected with a clockwise pivot movement of the latch.

If the latch is released again, then the spring assembly 16 which is loaded during pivoting of the latch ensures return of the latch arm to the vertical position. The necessary movement play is guaranteed by a correspondingly large notch 14.

Figure 5:
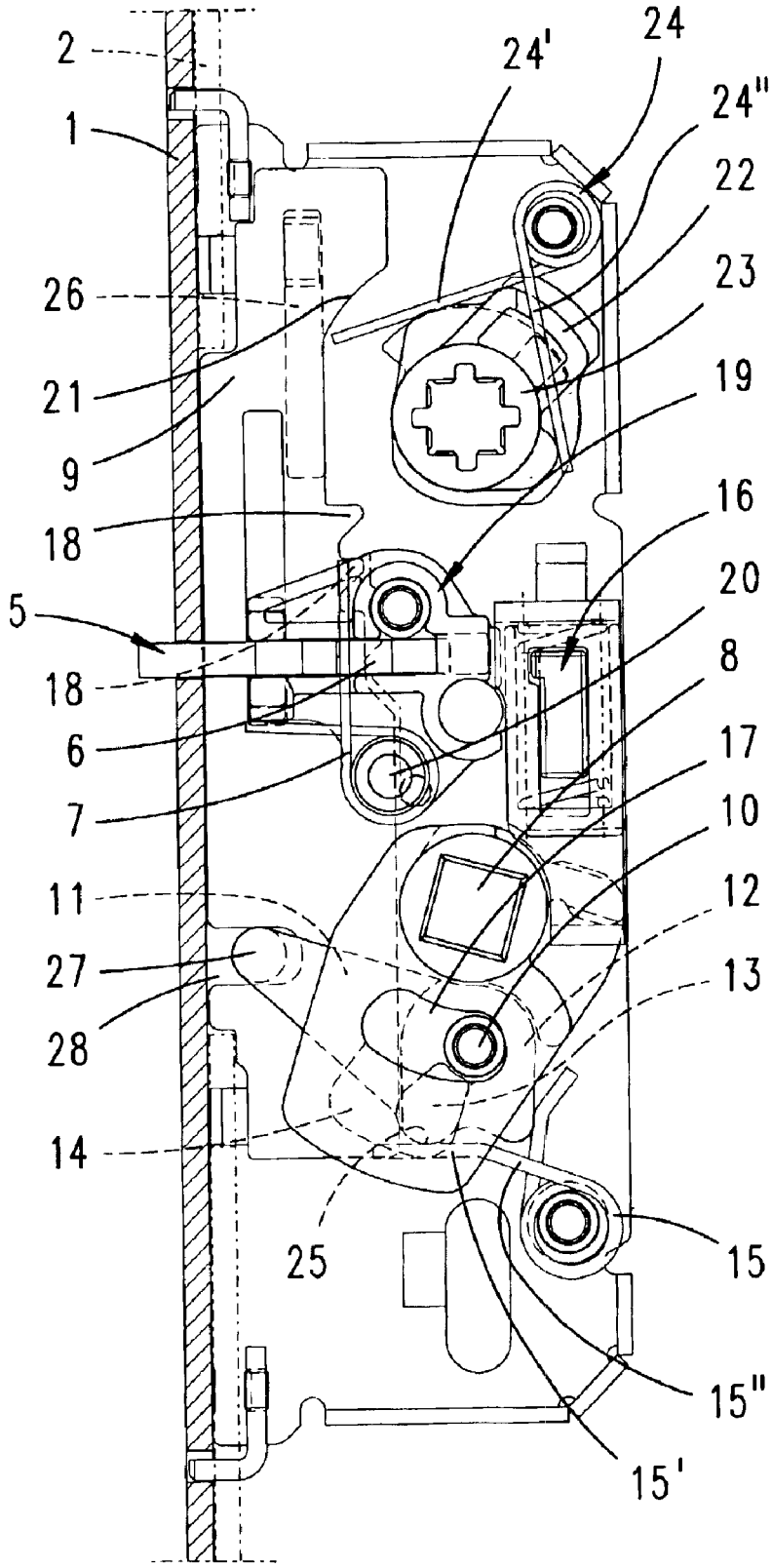

While in the open position shown in FIG. 2 the blokking nut 23 cannot be displaced into the blocking position, it can be displaced into a blocking position in the blocking position shown in FIG. 5. In the process the blocking member 22 which is formed by a nut arm of the blocking nut 23 places itself in front of the blocking shoulder 21 of the driving rod connecting slide 9, so that the latter cannot be displaced linearly.

Figure 4:
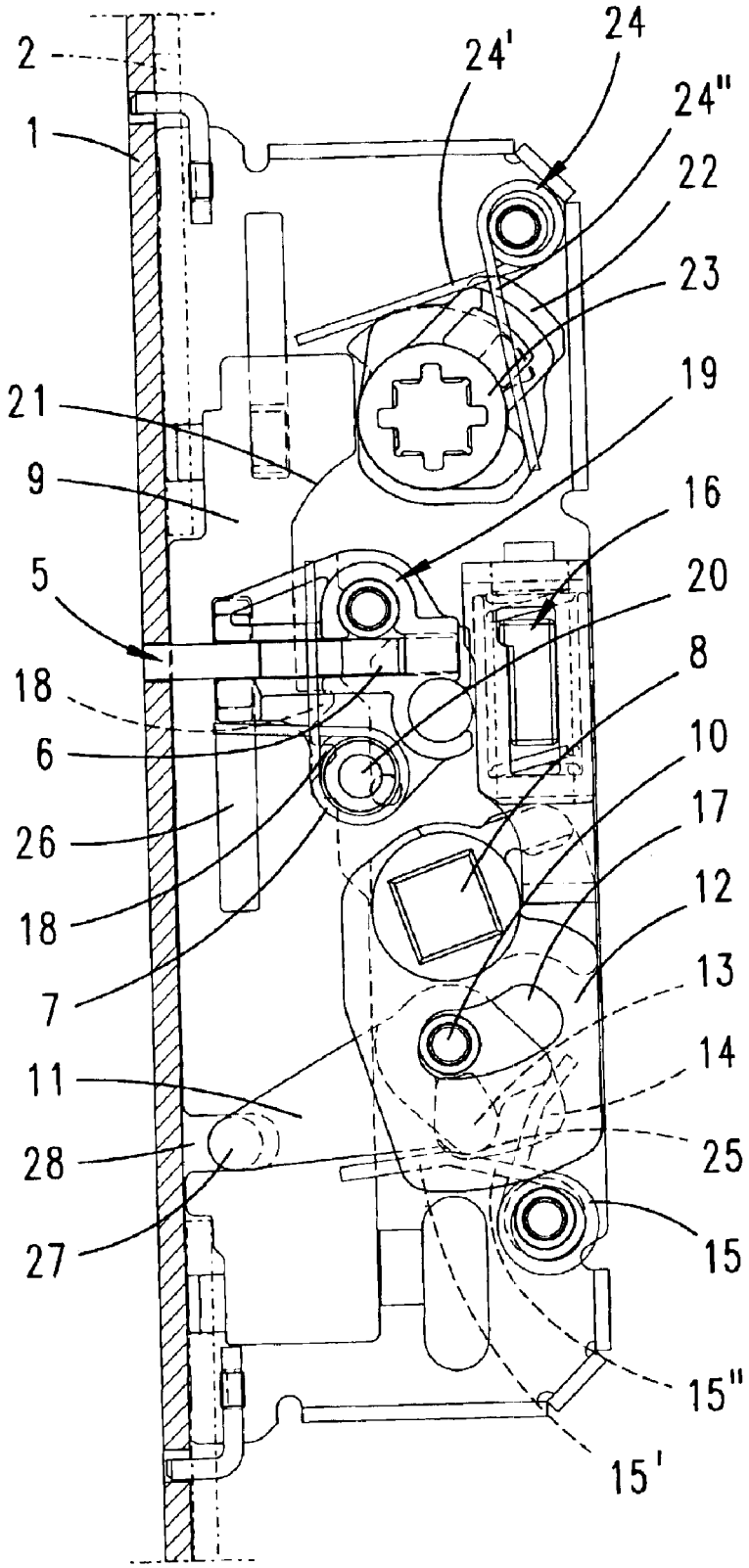

To open the lock, the latch is pivoted anti-clockwise. This pivot movement is transmitted to the cam 13. The driving lever 11 displaces the driving rod into the open position. The latch nut 8 then adopts the position shown in FIG. 4. Here too the spring assembly 16 which is taut during rotation of the latch nut 8 ensures return of the latch nut to the central, neutral position.

All the characteristics disclosed are (independently) essential to the invention. The disclosure of the application hereby also includes in full the disclosure content of the associated/attached priority documents (copy of the earlier application), for the purpose of also including characteristics of these documents in claims of the present application as well.

What is claimed is:

1. Driving rod lock for a sliding door, with a lock housing (2) which is arranged to the rear of a cuff plate (1) and which comprises a driving member for a driving rod (3) for driving bolt elements (4), which driving rod is displaceable between a blocked position and an open position of the lock by actuation of the driving member along the rear side of the cuff plate, with a tracer (5) which extends through an opening of the cuff plate (1) and which, with a blocking section (6) arranged in the lock housing (2), blocks displacement of the driving rod (3) from the open into the closed position and releases displacement in a position pressed in against force of a return spring (7), wherein the driving member is a latch nut (8), the lock further comprising a driving rod connecting slide (9) which is guided in the lock housing (2) and which is engaged by a driving lever (11) which is pivotable about a shaft (10) fixed to the housing and which is actuatable by an arm (12) of the latch nut (8), and wherein the driving lever (11) forms a short lever, which is formed by a cam (13), and wherein said cam (13) lies with play in a notch (14) of the nut arm.

2. Driving rod lock for a sliding door, with a lock housing (2) which is arranged to the rear of a cuff plate (1) and which comprises a driving member for a driving rod (3) for driving bolt elements (4), which driving rod is displaceable between a blocked position and an open position of the lock by actuation of the driving member along the rear side of the cuff plate, with a tracer (5) which extends through an opening of the cuff plate (1) and which, with a blocking section (6) arranged in the lock housing (2), blocks displacement of the driving rod (3) from the open into the closed position and releases displacement in a position pressed in against force of a return spring (7), wherein the driving member is a latch nut (8), the lock further comprising a driving rod connecting slide (9) which is guided in the lock housing (2) and which is engaged by a driving lever (11) which is pivotable about a shaft (10) fixed to the housing and which is actuatable by an arm (12) of the latch nut (8), and wherein the driving lever (11) cooperates with a positioning spring (15) which, as a result of over-center control, holds the driving rod connecting slide (9) both in a pivot position associated with the blocked position and in one associated with the closed position.

3. Driving rod lock according to claim 2, wherein the positioning spring (15) is a leg spring.

4. Driving rod lock for a sliding door, with a lock housing (2) which is arranged to the rear of a cuff plate (1) and which comprises a driving member for a driving rod (3) for driving bolt elements (4), which driving rod is displaceable between a blocked position and an open position of the lock by actuation of the driving member along the rear side of the cuff plate, with a tracer (5) which extends through an opening of the cuff plate (1) and which, with a blocking section (6) arranged in the lock housing (2), blocks displacement of the driving rod (3) from the open into the closed position and releases displacement in a position pressed in against force of a return spring (7), wherein the driving member is a latch nut (8), the lock further comprising a driving rod connecting slide (9) which is guided in the lock housing (2) and which is engaged by a driving lever (11) which is pivotable about a shaft (10) fixed to the housing and which is actuatable by an arm (12) of the latch nut (8), and wherein the bearing shaft (10) of the driving lever (11) extends through an arcuate slot (17) of the nut arm (12).

5. Driving rod lock for a sliding door, with a lock housing (2) which is arranged to the rear of a cuff plate (1) and which comprises a driving member for a driving rod (3) for driving bolt elements (4), which driving rod is displaceable between a blocked position and an open position of the lock by actuation of the driving member along the rear side of the cuff plate, with a tracer (5) which extends through an opening of the cuff plate (1) and which, with a blocking section (6) arranged in the lock housing (2), blocks displacement of the driving rod (3) from the open into the closed position and releases displacement in a position pressed in against force of a return spring (7), wherein the driving member is a latch nut (8), the lock further comprising a driving rod connecting slide (9) which is guided in the lock housing (2) and which is engaged by a driving lever (11) which is pivotable about a shaft (10) fixed to the housing and which is actuatable by an arm (12) of the latch nut (8), and wherein the tracer (5) is a slide which is acted upon by leg spring (7) and which cooperates with blocking extension (6) with sawtooth-shaped blocking teeth (18) of the driving rod connecting slide (9).

6. Driving rod lock according to claim 5, wherein the tracer is mounted in a guide molding (19), which also forms a bearing pin (20) for the leg spring (7).

7. Driving rod lock according to claim 6, wherein the guide molding (19) is made of plastic.

8. Driving rod lock for a sliding door, with a lock housing (2) which is arranged to the rear of a cuff plate (1) and which comprises a driving member for a driving rod (3) for driving bolt elements (4), which driving rod is displaceable between a blocked position and an open position of the lock by actuation of the driving member along the rear side of the cuff plate, with a tracer (5) which extends through an opening of the cuff plate (1) and which, with a blocking section (6) arranged in the lock housing (2), blocks displacement of the driving rod (3) from the open into the closed position and releases displacement in a position pressed in against force of a return spring (7), wherein the driving member is a latch nut (8), the lock further comprising a driving rod connecting slide (9) which is guided in the lock housing (2) and which is engaged by a driving lever (11) which is pivotable about a shaft (10) fixed to the housing and which is actuatable by an arm (12) of the latch nut (8), and wherein the driving rod connecting slide (9) has a blocking shoulder (21) to which a blocking member (22) is appliable in the blocked positions said blocking member (22) preventing displacement of the driving rod into the open position.

9. Driving rod lock according to claim 8, wherein the blocking member (22) is a blocking arm of a blocking nut (23).

10. Driving rod lock according to claim 9, wherein the blocking nut (23) is held by a leg spring (24) in its pivot end positions.

* * * * *